US009669417B2

(12) United States Patent
Goisot et al.

(10) Patent No.: US 9,669,417 B2
(45) Date of Patent: Jun. 6, 2017

(54) APPARATUS FOR ELECTROSTATICALLY SPRAYING A COATING PRODUCT AND METHOD FOR CONTROLLING GENERATOR FOR SUPPLYING POWER TO A HIGH-VOLTAGE UNIT IN SUCH AN APPARATUS

(71) Applicant: Sames Technologies, Meylan (FR)

(72) Inventors: Gilles Goisot, Saint Ismier (FR); Michel Di-Gioia, Seyssinet (FR)

(73) Assignee: SAMES TECHNOLOGIES, Meylan (FR)

( * ) Notice: Subject to any disclaimer, the term of this patent is extended or adjusted under 35 U.S.C. 154(b) by 0 days.

(21) Appl. No.: 14/781,216

(22) PCT Filed: Apr. 8, 2014

(86) PCT No.: PCT/EP2014/056980
§ 371 (c)(1),
(2) Date: Sep. 29, 2015

(87) PCT Pub. No.: WO2014/166902
PCT Pub. Date: Oct. 16, 2014

(65) Prior Publication Data

US 2016/0051998 A1 Feb. 25, 2016

(30) Foreign Application Priority Data

Apr. 9, 2013 (FR) ..... 13 53185

(51) Int. Cl.
*B05B 5/053* (2006.01)
*B05B 5/03* (2006.01)
(Continued)

(52) U.S. Cl.
CPC ..... *B05B 5/0531* (2013.01); *B05B 1/3046* (2013.01); *B05B 5/005* (2013.01);
(Continued)

(58) Field of Classification Search
CPC ..... B05B 1/3046; B05B 5/005; B05B 5/006; B05B 5/025; B05B 5/03; B05B 5/053; B05B 5/0531; B05B 12/002
See application file for complete search history.

(56) References Cited

U.S. PATENT DOCUMENTS 4,441,656 A * 4/1984 Huber ..... B05B 5/0531 239/289
4,752,034 A 6/1988 Kuhn et al.
(Continued)

FOREIGN PATENT DOCUMENTS

JP 2004267960 A 9/2004

OTHER PUBLICATIONS

International Search Report for PCT/EP2014/056980 dated Aug. 26, 2014.
French Search Report for FR1353185 dated Dec. 6, 2013.

*Primary Examiner* — Darren W Gorman
(74) *Attorney, Agent, or Firm* — Pearne & Gordon LLP

(57) ABSTRACT

An apparatus for electrostatically spraying a coating product. The apparatus includes a sprayer with first and second pipes which control the flow of the coating product. Air is controlled by at least one valve. The sprayer includes a device for controlling the opening/closing of the valve, a high voltage unit. A generator includes a module for controlling power supplied to the high voltage unit. The sprayer includes a first sensor suitable for detecting the position of a shutter of the valve relative to a seat and for outputting a signal used by the control module to control the power supplied to the high voltage unit, and a second sensor suitable for detecting the position of a switch positioned on the spray gun and for outputting a signal used by the control module to control the power supply of the high voltage unit.

17 Claims, 1 Drawing Sheet

(51) Int. Cl.

| | |
|---|---|
| ***B05B 5/025*** | (2006.01) |
| ***B05B 1/30*** | (2006.01) |
| ***B05B 12/00*** | (2006.01) |
| ***B05B 5/00*** | (2006.01) |

(52) U.S. Cl.
CPC ..... *B05B 5/03* (2013.01); *B05B 5/053* (2013.01); *B05B 12/002* (2013.01)

(56) References Cited

U.S. PATENT DOCUMENTS

| | | | | |
|---|---|---|---|---|
| 5,022,590 | A | 6/1991 | Buschor | |
| 5,765,761 | A * | 6/1998 | Law | B05B 5/03 239/690.1 |
| 2008/0111000 | A1 * | 5/2008 | Buquet | B05B 5/053 239/3 |

* cited by examiner

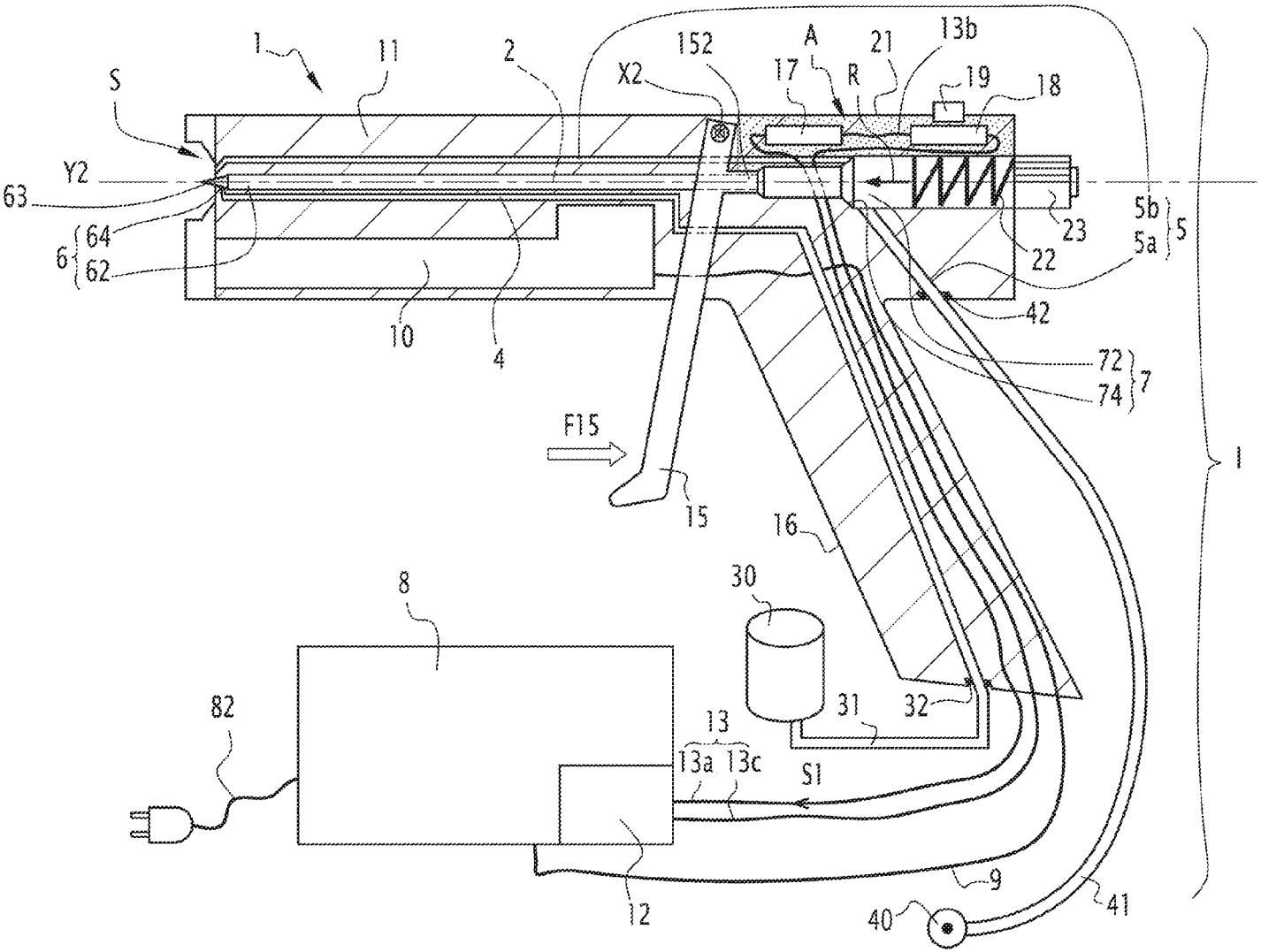
1
5
5b
5a
7
72
74
41
23
22
42
18
19
13b
21
R
A
17
152
X2
9
40
32
31
S1
16
30
13
13a
13c
15
F15
12
2
4
10
11
8
82
S
Y2
63
6
64
62

APPARATUS FOR ELECTROSTATICALLY SPRAYING A COATING PRODUCT AND METHOD FOR CONTROLLING GENERATOR FOR SUPPLYING POWER TO A HIGH-VOLTAGE UNIT IN SUCH AN APPARATUS

This application is a National Stage application of PCT international application PCT/EP2014/056980, filed on Apr. 8, 2014 which claims the priority of French Patent Application No. 1353185 entitled "APPARATUS FOR ELECTROSTATICALLY SPRAYING A COATING PRODUCT AND METHOD FOR CONTROLLING GENERATOR FOR SUPPLYING POWER TO A HIGH VOLTAGE UNIT IN SUCH AN APPARATUS", filed with the French Patent Office on Apr. 9, 2013, both of which are incorporated herein by reference in their entirety.

FIELD OF THE INVENTION

The invention relates to an apparatus for electrostatically spraying a coating product as well as a method for controlling a generator supplying power to a high-voltage unit in such an apparatus.

BACKGROUND OF THE INVENTION

Apparatuses for electrostatically spraying a coating product make it possible to electrostatically charge a coating product and offer a good transfer rate of the coating product onto the support to be covered.

One recurring issue in apparatuses for electrostatically spraying a coating product is controlling the start-up of the electrostatic high voltage, and therefore controlling a generator for supplying power to a high-voltage unit comprised in a sprayer, the sprayer being comprised in the apparatus.

In the field of spraying a coating product using an electrostatic sprayer, it is known to install, on a spraying air flow pipe of the sprayer, a pneumatic switch, more frequently called "flow rate contact", which closes an electric contact when it detects a sufficient air flow rate. The closing of the electric contact makes it possible to supply power to a high-voltage unit. Such a flow rate contact has a relatively long response time, a significant bulk and weight, and a high remanence. Its operation is not very reliable when the air flow rate is low. This means that the triggering point for the high voltage is more or less precise, in particular due to the response time and remanence of the sensor.

It is also known from U.S. Pat. No. 4,441,656 to control a generator for supplying power to a high-voltage unit owing to the position of one end of a trigger actuated by an operator. This approach makes possible to ensure that the high voltage is triggered only when the trigger is actuated. This material does not make it possible to account for any defects in the air supply of a sprayer in which spraying air is used. Furthermore, this device is cumbersome, heavy and expensive.

It is also known to produce a sprayer for which the action on a trigger opens an air leak in the sprayer, that leak being protected by one or two pressure sensors mounted in differential that make it possible, when such an air leak is detected, to trigger a generator for supplying power to a high-voltage unit. The problem created by the use of an air leak on a sprayer is a needless consumption of compressed air, which quite often a source of bother for the operator, and the establishment of complex pneumatic circuits that withstand temporary overloads poorly, which is a source of breakdowns and malfunctions. Furthermore, in this type of system, time drift phenomena are commonly observed in the detection threshold of the pressure sensors. This means that the high-voltage unit is no longer reliably triggered, resulting in significant excess product consumption and additional risks for the safety of people and property.

Furthermore, it is known from FR-A-2,578,450 to use a first magnetic sensor actuated by a permanent magnet positioned in a variable position on a gun body and a second sensor used as a switch and which makes it possible to deliberately cut the generation of a high voltage by a high-voltage unit, so as to facilitate the coating of hollow bodies. This type of device implies that the sensors must be able to cut an alternating voltage varying from 20 to 35 kHz with an intensity of at least 1 A and a peak voltage of approximately 80 to 100 Volts. Indeed, once the sensors are actuated, they directly cut the electricity supply of the high-voltage unit by closing or cutting the electricity circuit of the primary of the transformer. Then, during the use of this type of apparatus, the operator presses and releases a trigger of a sprayer between 6 and 12 times per minute. The first sensor is therefore considerably biased. These stresses lead to using sensors with dimensions that are practically incompatible with their insertion inside a gun for electrostatically spraying a coating product, and even using large sensors, their lifespan is greatly reduced in such a device, due to the high voltage and current levels that they must cut.

Also known from JP-A-2004 26 7960 is an electrostatic spraying apparatus that comprises a module for controlling the current delivered to a high-voltage unit, as a function of a specific parameter inherent to an air valve of the sprayer. However, in such an apparatus, the control module directly cuts the current and voltage delivered to the high-voltage unit by the control module, which creates problems in terms of lifespan and sizing of the control module and any member for measuring a specific parameter.

The invention more particularly aims to resolve these drawbacks by proposing an apparatus for electrostatically spraying a coating product that allows a reliable and precise control of a power supply generator of a high-voltage unit, without having to detect the consumption of a fluid, such as air or coating product.

BRIEF SUMMARY OF THE INVENTION

To that end, the invention relates to an apparatus for electrostatically spraying a coating product comprising:

- a sprayer provided with a first pipe and a second pipe, respectively for the flow of coating product and air, in which the flow of coating product and air is controlled by at least one valve, said sprayer also comprising means for controlling the opening/closing of the valve and a high-voltage unit,
- a high-voltage unit power supply generator, said generator comprising a control module for the current delivered to the high-voltage unit.

According to the invention, the sprayer comprises at least one first sensor able to detect the position of a shutter of the valve relative to the seat and outputting a signal that can be used by the control module to control the supply of current for the high-voltage unit, while the sprayer comprises a second sensor able to detect the position of a switch positioned on the gun and to deliver a signal that can be used by the control module to control the power supply for the high-voltage unit.

Owing to the invention, the sensors used have dimensions compatible with their insertion in a sprayer gun, since the current and voltage crossing through the sensors have low levels. In fact, the signal produced by the sensor does not directly cut the power supply of the high-voltage unit, but rather sends a signal to the control module for the current delivered to the high-voltage unit that cuts or itself triggers the power supply of the high-voltage unit as a function of the signal. This creates a much safer and longer lasting operation of the sensors, and the control of the power supply of the high-voltage unit is improved.

According to advantageous but optional aspects of the invention, such an apparatus for electrostatically spraying a coating product may incorporate one or more of the following features, considered in any technically possible combination:

- The sprayer comprises a first valve controlling the flow of coating product in the first pipe and a second valve controlling the flow of air between two segments of the second pipe, while the first sensor is able to detect the position of a shutter of the first valve.
- The sprayer comprises a first valve controlling the flow of coating product in the first pipe and a second valve controlling the flow of air between two segments of the second pipe, while the first sensor is able to detect the position of a shutter of the second valve.
- The first valve controlling the flow of coating product comprises a shutter forming a needle sliding in a barrel of the sprayer, designed to control the flow of coating product and designed to be brought to a high voltage, to electrically charge the coating product.
- The sprayer comprises a spring made from a nonmagnetic material that exerts a return force on the shutter of the valve.
- The needle comprises an end with a shape suitable for bearing against a seat of the first valve with a corresponding shape under the effect of the return force.
- The high-voltage unit is positioned in the barrel of the sprayer and is able, in response to the supply of the high-voltage unit by the power source, to generate a direct high voltage and to apply the high voltage to the end of the needle.
- The switch is designed to be manipulated by an operator to go from a first configuration of the sprayer, where the high voltage is applied to the end of the needle, to a second configuration, where the high-voltage unit is not supplied with electricity.
- The second valve controlling the flow of air comprises a shutter, with a suitable shape for bearing against a seat of the second valve with a corresponding shape, under the effect of the return force.
- A trigger is articulated on the body of the sprayer around an axis globally perpendicular to a longitudinal axis of a barrel of the sprayer.
- The trigger comprises an extension, bearing against the shutter of the valve and able to exert, on the shutter, a force opposite the return force, to axially offset the shutter of the valve, along the longitudinal axis, relative to the seat.
- The first and second sensors are mounted in series on a cable connecting those sensors to the control module.
- The first sensor is a Reed sensor or a Hall effect sensor.
- The sprayer comprises a tight zone within which the sensor(s) are positioned.

The invention also relates to a method for controlling a power supply generator of a high-voltage unit comprised in an apparatus for electrostatically spraying a coating product. According to the invention, the method comprises the following steps:

a) detecting the position of a shutter of a valve comprised in the sprayer and setting in motion using its opening/closing means, on the one hand, and changing the position of a switch fastened on the gun on the other hand;
b) sending a signal corresponding to the position of the valve and the position of the switch to a control module of the generator by means of a connection suitable for the type of sensor used;
c) controlling the cut-off or triggering of the generator, based on the received signal and using the control module.

BRIEF DESCRIPTION OF THE DRAWING

The invention will be better understood and other advantages thereof will appear more clearly in light of the following description of one embodiment of an apparatus for electrostatically spraying a coating product and a control method according to its principle, provided solely as an example and done in reference to the appended drawing, in which FIG. 1 diagrammatically shows an apparatus according to the invention, with a sprayer shown in cross-section.

DETAILED DESCRIPTION OF THE INVENTION

The apparatus I shown in FIG. 1 allows electrostatic coating of an object, not shown. This apparatus I comprises a sprayer or gun 1 for electrostatic coating supplied with liquid coating product from a coating product reservoir 30, via a tube 31.

The gun 1 is also connected to a pressurized air source 40 by a tube 41. The air coming from the source 40 is used to spray the coating product by driving it from the gun 1 toward the object to be coated.

Reference 2 denotes a housing situated in a barrel 11 of the gun 1 in which a needle 62 slides. The needle is designed to control the flow of coating product and designed to be brought to a high voltage so as to electrically charge the coating product.

Reference 4 denotes a pipe for the flow of coating product inside the gun 1. This pipe 4 for the flow of the coating product is connected to the hose 31 by means of a connector 32, situated at the base of a handle 16 of the sprayer 1. The pipe 4 emerges near an outlet S for spraying a coating product at one end 63 of the needle 62 that forms a triangular tip. In FIG. 1, the end 63 bears against a seat 64 with a corresponding shape and plugs the pipe 4. Thus, the assembly formed by the needle 62 and the seat 64 corresponds to a valve 6 for controlling the flow of the coating product.

Reference 5 denotes a pipe for the flow of air inside the gun 1. That pipe 5 comprises two segments 5*a*, 5*b*, between which there is a valve 7 for controlling the flow of air. The second segment 5*b* of the pipe 5 emerges at the outlet S for spraying the coating product.

The air flow pipe 5 is connected to the hose 41 by means of a connector 42, situated behind a body 21 of the gun 1.

The valve 7 for controlling the flow of air comprises a shutter 72, with a shape suitable for bearing against a seat 74, with a corresponding shape, under the effect of a return force R exerted by a spring 22 kept in position by a stopper 23 forming a fixed bearing point for that spring 22. Similarly, the end 63 of the needle 62 has a suitable shape for bearing against the seat 64, with a corresponding shape, under the effect of the return force R.

The gun 1 is also connected to a generator 8 by an electric cable 9 that makes it possible to supply power to a high-voltage unit 10, positioned in the barrel 11 of the gun 1. The generator 8 itself is supplied with power from the sector, using a cable 82.

Reference 12 denotes a module for controlling the power supply delivered to the high-voltage unit 10 by the generator 8. This control module 12 is comprised in the generator 8. When it is supplied by the generator 8, the high-voltage unit 10 generates a direct high voltage applied to the end 63 of the needle 62 that electrically charges the sprayed coating product at the outlet S by ionization. Thus, the high-voltage unit is able, in response to its supply from the generator 8, also called power supply 8, to generate a direct high-voltage and to apply the high-voltage to the end 63 of the needle 62.

Advantageously, the high-voltage unit is able, in response to being powered by the generator 8, to generate a direct high voltage and to apply the high voltage to a charge electrode, not shown, positioned at the outlet S, near the end 63. The coating product is thus electrically charged.

A trigger 15 is articulated on the body 21 of the gun 1 around an axis X2 globally perpendicular to the longitudinal axis of the barrel Y2 and makes it possible to open and close the air valve and allows the needle 62 to move in a direction parallel to the axis Y2. More specifically, the trigger 15 comprises an extension 152 bearing against the shutter 72, which makes it possible to exert a force on the shutter 72 opposite the return force R to axially shift the shutter 72, along the axis Y2, relative to its seat 74. The extension 152 is therefore able to exert, on the shutter 72, a force opposite the return force R to shift the shutter 72 axially, along the longitudinal axis Y2, relative to the seat 74. Likewise, the needle 62 is attached to the extension 152, which makes it possible to exert, on the needle 62, a force opposite the return force R to shift the needle 62 axially along the axis Y2, and more specifically its end 63 relative to its seat 64. The extension 152 is therefore able to exert, on the needle 62, a force opposite the return force R to shift the needle 62 axially, along the longitudinal axis Y2, relative to the seat 64. When the handle 15 is released, the spring 22 pushes the needle 62 and the shutter 72 back toward the position interrupting the pipes 4 and 5 shown in FIG. 1. The trigger 15 thus makes it possible to control the flow of coating product and pressurized air in the pipes 4, 5.

A sensor 17 is positioned in the body 21 near the needle 62 and detects the movement of the needle 62 when the trigger 15 is actuated. This sensor 17 may be of any type adapted to its function, and in particular, a Reed sensor. Alternatively, it is a capacitive or inductive sensor or a Hall effect sensor, or a magnetic field detector. When the operator actuates the trigger 15 and exerts a force represented by arrow F15, the end 63 of the needle 62 is taken off of the seat 64 and a flow of coating product is produced through the pipe 4. At the same time, the shutter 72 of the air valve 7 is taken off of the seat 74 and a flow of air is produced through the air flow pipe 5. Thus, a flow of air and coating product is produced toward the outlet S.

The sensor 17 is connected to the control module 12 by means of the cable 13.

Furthermore, a second sensor 18 is positioned near a switch 19 positioned on the body 21 of the gun 1. The operator can manually change the position of the switch 19, knowing that the sensor 18 is able to detect the position of the switch 19. The sensor 18 may be of the same type as the sensor 17 or of another type.

The cable 13 comprises a first segment 13*a* that extends between the control module 12 and the sensor 17, a second segment 13*b* that extends between the sensors 17 and 18, and a third segment 13*c* that extends between the sensor 18 and the control module 12. Thus, the sensors 17 and 18 are connected in series to the control module 12, through the cable 13. The sensors 17 and 18 are for example mounted on a printed circuit, not shown, and overmolded in an electrically insulating resin.

The switch 19 is designed to be manipulated by the operator to go from a first "electrostatic" configuration of the gun where the high voltage is applied to the end 63 of the needle 62 to a second "purely pneumatic" configuration where the unit 10 is no longer supplied. This second configuration is useful to coat certain hollow objects or objects with complex shapes.

Furthermore, the spring 22 is made from a nonmagnetic material. It therefore does not disrupt the movement detection done by the sensors 18, 17 in the event the sensors 17, 18 are Reed sensors, and more generally magnetic-type sensors.

The serial connection between the sensor 17, the sensor 18 and the control module 12 makes it possible to send a signal S1 to the control module 12 representative of the movement of the needle 62 and the position of the switch 19. The control module 12 controls the power supply of the high-voltage unit 10 as a function of the value of the received signal S1.

The sensors 17 and 18 are positioned in a zone A of the body 21 that is sealed so that no impurity disrupts their operation. In the usage configuration of the gun 1 shown in FIG. 1, the zone A is situated above the valve 7 and the needle 62, in the upper part of body 21, which facilitates access to the switch 19.

In order to control the high-voltage unit 10, the electrostatic spraying apparatus detects the movement of the needle 62 and takes any change in position of the switch 19 into account.

In the event the sensors 17 and 18 are Reed sensors, they are positioned in the part A of the body 21 to be closed when the needle 62 is offset from the seat 64 and when the switch 19 is the first ON position corresponding to the "electrostatic" position of the gun 1. Thus, when the operator actuates the trigger 15 while the switch 19 is in its first position, the cable 13 forms an uninterrupted electric loop, which can be detected by the control module 12, which injects a signal on that cable and recovers it in the form of the signal S1. In that case, the control module 12 steers the generator 8 to supply the unit 10. In the event one of the sensors 17, 18 is open, i.e., if the needle 62 and more particularly its end 63 bears on the seat 64, or if the switch 19 is in a second OFF position corresponding to the "purely pneumatic" configuration of the gun, the loop formed by the cable 13 is interrupted and the recovered signal S1 is null. In that case, the control module 12 steers the generator 8 not to supply the unit 10.

Other manners of transmitting the signal S1 to the control module 12 can be considered, in particular as a function of the type of sensors 17 and 18.

In all cases, a signal S1 corresponding to the movement of the coating product valve 6, and more particularly the needle 62, and the position of the switch 19 is sent to the control module 12 via the cable 13 appropriate for the type of sensor used. The control module 12 triggers or cuts the power supply of the high-voltage unit 10 as a function of the received signal S1.

When the switch 19 is in the OFF position, the signal S1 sent by the sensor 18 to the control module 12 triggers the cutoff of the power supply of the high-voltage unit 10 by the generator 8. That cutoff is maintained until the switch 19 is in the ON position, and for example allows the operator to more easily coat the hollow bodies while avoiding counter-emission or Faraday cage phenomena.

When the switch 19 is in the ON position, the cutoff or triggering of the supply of the high-voltage unit 10 by the generator 8 depends on the position of the needle 62 of the coating product valve 6. If the detected movement corresponds to a travel exceeding the reference value, then the signal S1 sent by the sensor 17 to the control module 12 causes the triggering of the supply of the high-voltage unit, and otherwise, the signal S1 sent by the sensor 17 causes the cutoff or non-triggering of the supply of the high-voltage unit.

Alternatively, the sensor 17 detects a movement of the shutter 72 of the air valve 7 and not a movement of the needle 62 of the valve 6. The operation remains identical to that previously described.

According to another alternative, the sprayer may also comprise a sensor 17 and no sensor 18 or switch 19. In that case, the triggering of the high voltage may not be cut manually by the operator and depends only on the movement of the valve 7 or the valve 6.

The apparatus shown in FIG. 1 has a manual sprayer. The invention is, however, applicable to an automatic sprayer, in which case the valves are controlled remotely.

According to another alternative, the sprayed coating product is powdered, in which case, it suffices to have only one coating product flow pipe through which the powdered coating product is pneumatically conveyed. There is no need for an air flow pipe, and a single valve is used.

According to one alternative, the connection between the sensors 17, 18 and the control module 12 is a wireless connection. The sensors 17, 18 can transmit the signal S1 to the control module 12 using radio waves.

According to another alternative, the generator 8 is supplied by an autonomous source.

According to another alternative, the air flow pipe 5 comprises two second segments that are positioned along the housing of the needle and emerge at the outlet S on either side of the needle 62.

The technical features of the embodiment and alternatives considered above may be combined with one another to create other embodiments.

The invention claimed is:

1. An apparatus for electrostatically spraying a coating product comprising:

a sprayer provided with a first pipe and a second pipe, respectively for the flow of coating product and air, in which the flow of coating product and air is controlled by at least one valve, the sprayer also comprising:

a control device for controlling the opening/closing of the at least one valve, and a high-voltage unit, a generator for power supplying the high-voltage unit, the generator comprising a control module for controlling the current delivered to the high-voltage unit wherein the sprayer comprises at least one first sensor able to detect the position of a shutter of the at least one valve relative to a seat of the at least one valve and outputting a signal that can be used by the control module to control the supply of current for the high-voltage unit, and wherein the sprayer comprises a second sensor able to detect the position of a switch positioned on the sprayer and to deliver a signal that can be used by the control module to control the power supply for the high-voltage unit.

2. The apparatus according to claim 1, wherein the at least one valve comprises a first valve controlling the flow of coating product in the first pipe and a second valve controlling the flow of air between two segments of the second pipe, and wherein the at least one first sensor is able to detect the position of a shutter of the first valve.

3. The apparatus according to claim 1, wherein the at least one valve comprises a first valve controlling the flow of coating product in the first pipe and a second valve controlling the flow of air between two segments of the second pipe, and wherein the at least one first sensor is able to detect the position of a shutter of the second valve.

4. The apparatus according to claim 2, wherein the shutter of the first valve forms a needle sliding in a barrel of the sprayer, designed to control the flow of coating product and designed to be brought to a high voltage, to electrically charge the coating product.

5. The apparatus according to claim 1, wherein the sprayer comprises a spring made from a nonmagnetic material that exerts a return force on the shutter of the at least one valve.

6. The apparatus according to claim 4, wherein the sprayer comprises a spring made from a nonmagnetic material that exerts a return force on the shutter of the first valve and wherein the needle comprises an end with a shape suitable for bearing against a seat of the first valve with a corresponding shape under the effect of the return force.

7. The apparatus according to claim 6, wherein the high-voltage unit is positioned in the barrel of the sprayer and is able, in response to the supply of the high-voltage unit by the generator, to generate a direct high voltage and to apply the direct high voltage to the end of the needle.

8. The apparatus according to claim 7, wherein the switch is designed to be manipulated by an operator to go from a first configuration of the sprayer, where the high voltage is applied to the end of the needle, to a second configuration, where the high-voltage unit is not supplied with electricity.

9. The apparatus according to claim 2 wherein the sprayer comprises a spring made from a nonmagnetic material that exerts a return force on a shutter of the second valve and wherein the shutter of the second valve has a suitable shape for bearing against a seat of the second valve with a corresponding shape, under the effect of the return force.

10. The apparatus according to claim 1, wherein the sprayer comprises a body, a barrel, and the control device comprises a trigger, the trigger being articulated on the body around an axis globally perpendicular to a longitudinal axis of the barrel.

11. The apparatus according to claim 10, wherein the sprayer comprises a spring made from a nonmagnetic material that exerts a return force on the shutter of the at least one valve and wherein the trigger comprises an extension, bearing against the shutter of the at least one valve and able to exert, on the shutter of the at least one valve, a force opposite the return force, to axially offset the shutter of the at least one valve, along the longitudinal axis, relative to the seat of the at least one valve.

12. The apparatus according to claim 1, wherein the at least one first sensor and the second sensor are mounted in series on a cable connecting the at least one first sensor and the second sensor to the control module.

13. The apparatus according to claim 1, wherein the at least one first sensor is a Reed sensor or a Hall effect sensor.

14. The apparatus according to claim 1, wherein the sprayer comprises a zone that is sealed within which the at least one first sensor and the second sensor are positioned, so that no impurity disrupts the operation of the at least one first sensor and the second sensor.

15. A method for controlling a generator, the generator being adapted for power supplying a high-voltage unit, the high voltage unit being comprised in a sprayer for electrostatically spraying a coating product, wherein the method comprises the following steps:

a) detecting using sensors:

the position of a shutter of a valve, the valve being comprised in the sprayer and setting in motion using a control device for controlling the opening/closing of the valve and;

the changing of the position of a switch fastened on the sprayer;

b) sending to a control module of the generator, by means of a connection suitable for the type of sensors used, signals corresponding to the position of the valve and to the position of the switch;

c) controlling the cut-off or triggering of the generator, based on the signals received by the control module.

16. The apparatus according to claim 3, wherein a shutter of the first valve forms a needle sliding in a barrel of the sprayer, designed to control the flow of coating product and designed to be brought to a high voltage, to electrically charge the coating product.

17. The apparatus according to claim 16, wherein the sprayer comprises a spring made from a nonmagnetic material that exerts a return force on the shutter of the first valve and wherein the needle comprises an end with a shape suitable for bearing against a seat of the first valve with a corresponding shape under the effect of the return force.

* * * * *